United States Patent [19]

Zwillich

[11] 4,320,443

[45] Mar. 16, 1982

[54] FAUNA GUARD

[75] Inventor: Alexander Zwillich, Pittsburgh, Pa.

[73] Assignee: Westinghouse Electric Corp., Pittsburgh, Pa.

[21] Appl. No.: 143,208

[22] Filed: Apr. 24, 1980

[51] Int. Cl.[3] ..... F21P 1/02

[52] U.S. Cl. ..... 362/375; 362/362; 362/368; 362/370; 362/371; 362/374; 362/376

[58] Field of Search ..... 362/362, 368, 370, 371, 362/374, 375, 376

[56] References Cited

U.S. PATENT DOCUMENTS

| | | | |
|---|---|---|---|
| Re. 25,900 | 11/1965 | Husby | 362/362 |
| 3,353,015 | 11/1967 | Franklin | 362/374 |
| 3,530,287 | 9/1970 | Husby | 362/362 |
| 3,705,301 | 12/1972 | Franklin | 362/223 |
| 4,010,362 | 3/1977 | Fletcher | 362/375 |

*Primary Examiner*—Donald P. Walsh
*Attorney, Agent, or Firm*—B. R. Studebaker

[57] ABSTRACT

A generally planar, access limiting closure plate is provided in an outdoor lighting luminaire to close off the ballast and optical cavity portions of the luminaire from the exposed slip fitter mounting device at the end of the luminaire housing in order to prevent small animal from entering or nesting in the electrified portions of the luminaire.

8 Claims, 4 Drawing Figures

FAUNA GUARD

BACKGROUND OF THE INVENTION

This invention relates to outdoor area or street lighting luminaires of the ovate or tear drop shape and more particularly to a fauna guard, shield or closure member to prevent the ingress of small animals and birds into the interior, electrified portions of the luminair.

The ovate type street lighting or area lighting luminaire which enclosed the reflector, lamp, lamp socket and ballast as well as the mounting slip fitter within a single housing, as illustrated in the U.S. Pat. No. Re.25900 and U.S. Pat. No. 3,530,287 has evolved over the past 20 years into a more streamlined, lighter weight product through repeated cost reduction efforts. In the earlier versions the luminaire housing completely surrounded the slip fitter leaving only a small access aperture in the end of the luminaire housing for the support pipe to enter. With this construction the entrance of small animals and birds into the interior of the luminaire housing was not a particularly significant problem. As evidenced in U.S. Pat. No. 4,010,362 the problem was not non-existent even in luminaires which included a completely enclosed slip fitter area and in that patent a shield member comprising a generally U-shaped bendable sheet was arranged within the housing for substantially covering the opening between the housing and the support pipe to which the luminaire was mounted.

In the more modern type luminaire as disclosed in this application, the housing does not extend completely around the slip fitter portion of the luminaire thus rendering the luminaire easier to mount to the support pipe by providing ready access to the slip fitter mounting bolts without the necessity of removing a portion of the housing, opening a cover door or operating blindly through apertures in the housing wall. With this more modern cost effective construction entrance by small birds and animals into the interior electrified portion of the luminaire is much more likely and means prohibiting such entrance has become a necessary addition to the luminaire construction.

SUMMARY OF THE INVENTION

In accordance with the present invention the ingress of birds and small animals into the interior of a street lighting or area lighting luminaire has been prohibited by providing, in an outdoor lighting luminaire, including an elongated housing having slip fitter means at one end thereof for mounting the luminaire to a luminaire support and an optical cavity at the other end thereof for confining the reflector and light source, the improvement which comprises: a fauna guard releasably secured within the elongated housing intermediate the slip fitter means and the optical cavity. The closure means substantially closes off the optical cavity portion of the luminaire from access thereto by small animals. The fauna guard, in the form of a shield or closure means is a generally planar plate member having an apertured tab extending normal thereto for interconnection to a threaded boss on the underside of the luminaire housing and a pair lateral tab formed slots for receiving laterally disposed ribs on the internal housing wall. The generally planar plate member includes a first wiring access slot adjacent the base thereof and a second wiring access slot adjacent the top edge thereof with the first access slot permitting the power cable for the luminaire to extend through the plate member while the second elongated access slot permits wiring from the photo control to extend into the interior of the luminaire housing.

BRIEF DESCRIPTION OF THE DRAWING

Many of the attendant advantages of the present invention will become more readily apparent and better understood as the following detailed description is considered in connection with the accompanying drawing in which.

DESCRIPTION OF THE PREFERRED EMBODIMENT

Figure 1:
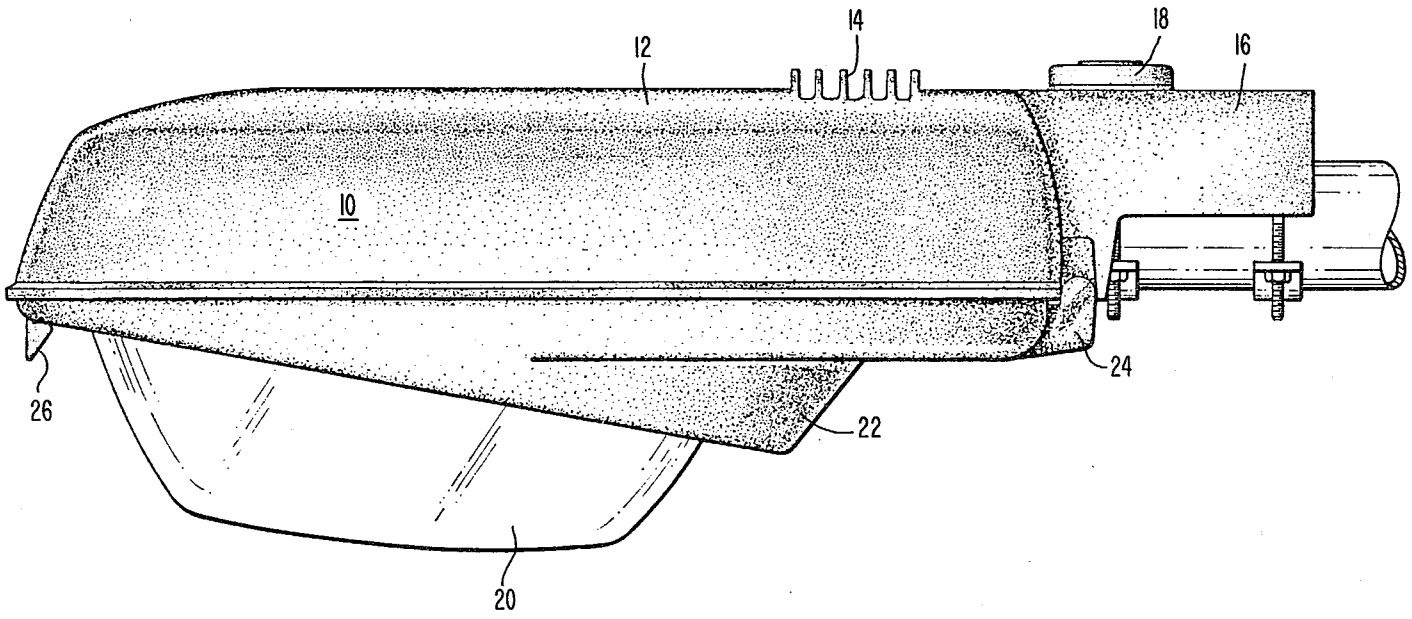
FIG. 1 is a side elevational view of a luminaire employing the fauna guard of this invention.
Figure 2:
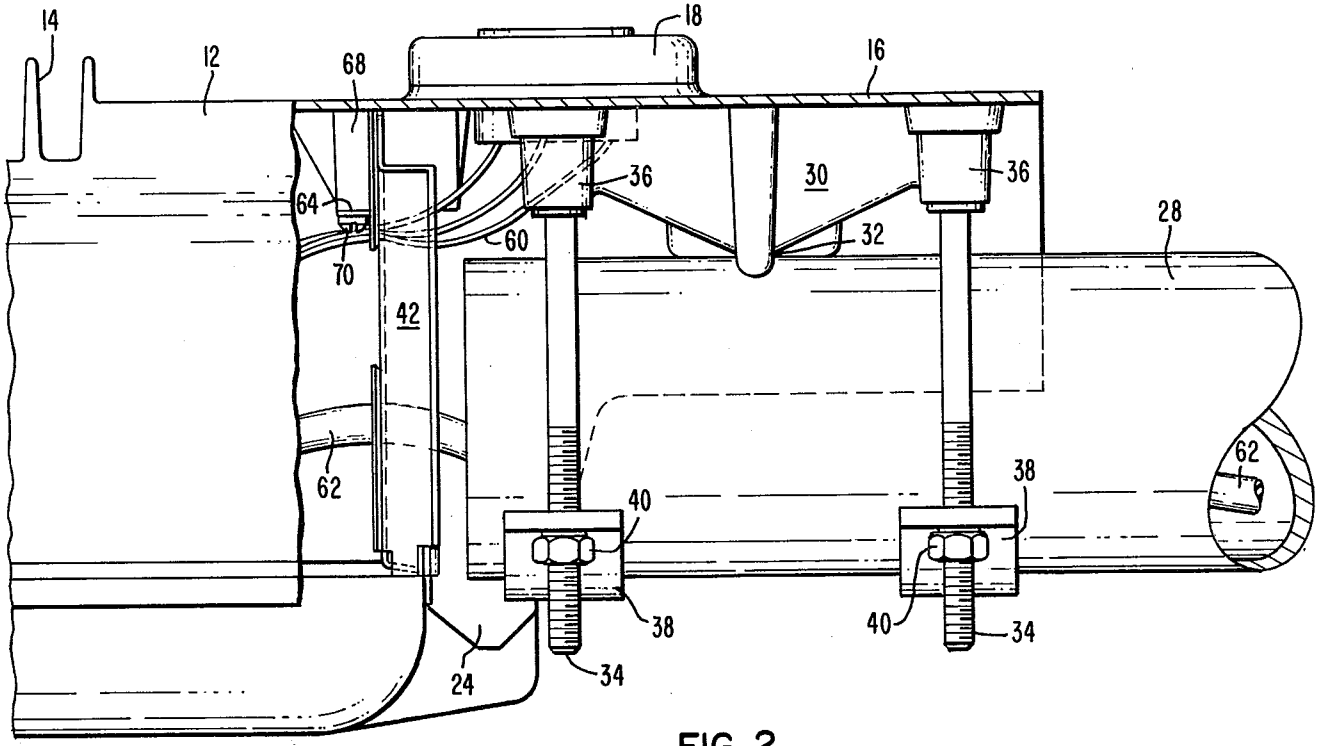
FIG. 2 is a side elevational view of the rearward end of the luminaire with a portion of the housing broken away.
Figure 3:
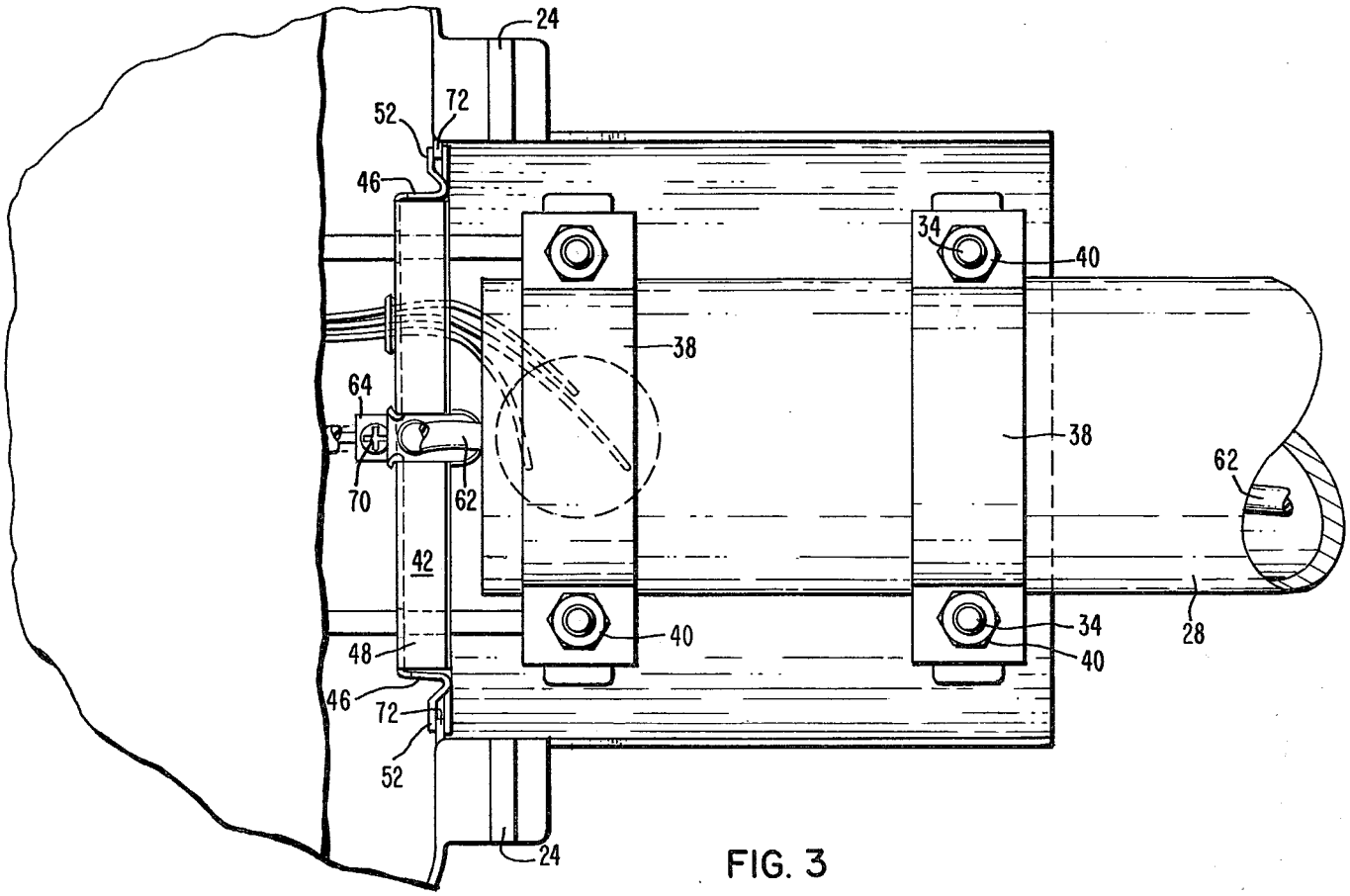
FIG. 3 is a bottom plan view similar to FIG. 2.

Referring now in detail to the drawings wherein like reference characters represent like parts throughout the several views, there is illustrated in FIG. 1 an outdoor street lighting or area lighting luminaire generally designated 10 employing the fauna guard of this invention. The luminaire 10 includes an elongated, inverted dish-shaped housing 12 including a plurality of heat-dissipating fins 14 on the top side thereof in the area of the housing in which the ballast is mounted and a rearward directed neck portion 16 which houses the slip fitter mounting mechanism. Also extending from the top rearward portion of the luminaire housing is a photo-control socket 18. In the forward portion of the luminaire housing there is located a conventional reflector and lamp socket (not shown) whch coact with the refractor 20 to form the optical cavity.

The refractor 20 is carried by a hinged door member 22 which is hinged to the luminaire housing at 24 adjacent the slip fitter and latched to the luminaire housing at the forward end by a latch mechanism 26.

The luminaire 10 is mounted to a luminaire support pipe 28 by means of a slip fitter generally designated 30 which includes a central pivot rib 32 and four threaded studs 34 which extend from bosses 36 in the luminaire housing extension 16. The slip fitter mechanism is conventional and includes a pair of curved strap members 38 one of which spans the forward pair of studs 34 while the other spans the rearward pair of studs 34. Four nuts 40 retain the straps 38 on the studs 34 and the angle of the luminaire with respect to the luminaire support pipe 28 can be adjusted by adjusting the nuts 40 to pivot the luminaire 10 with respect to the luminaire support pipe 28 abut the pivot point 32.

Figure 4:
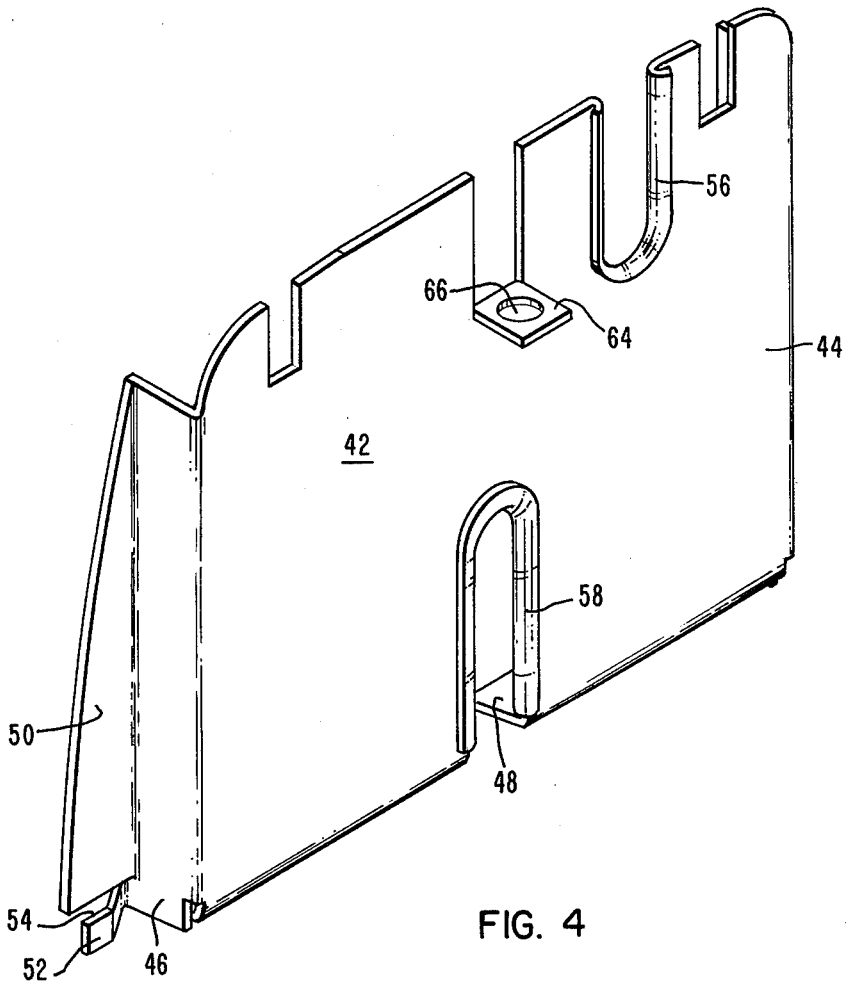
FIG. 4 is a perspective view of the fauna guard of this invention.

The fauna guard, shield or access limiting closure plate is best illustrated in FIG. 4 and is generally designated 42. The fauna guard 42 includes a generally planar central portion 44 extending at right angles to the planar central portion 44 are side walls 46 and a bottom wall 48. Arcuate edge or side closure portions 50 extend at right angles to the side walls 46 and are parallel to the central planar portion 44. The outer edges of the arcuate side closures 50 are of a contour which is substantially equivalent to the internal contour of the luminaire housing. The arcuate side closures 50 include at their bottom edge lateral tabs 52 which form a slot 54 between the tab 52 and the arcuate side closure 50. The planar central portion of the fauna guard closure means includes an upper wiring access slot 56 opening at the upper edge thereof and a lower wiring access slot 58 opening at the bottom edge of the planar portion 44. The upper wiring access slot provides an aperture in the fauna guard for electrical wiring 60 to interconnect the photo control socket 18 and the terminal block (not shown) within the luminaire housing. The lower wiring access slot 58 provides entrance into the luminaire housing for the luminaire power cable 62 which generally extends through the luminaire pipe support 28 and brings power to the terminal block within the luminaire housing.

Extending perpendicular to the planar portion 44 of the fauna guard is a mounting tab 64 having an aperture 66 therethrough, which tab 64 serves to mount the fauna guard 42 within the luminaire housing to close off the electrified portions of the luminaire. An internal boss 68 is molded into the underside of the luminaire housing and a threaded bolt 70 extends through the aperture 66 in the mounting tab 64 and is threaded into the internally threaded boss 68 to secure the fauna guard within the luminaire housing. The bottom end of the fauna guard 42 is secured by means of the slots 54 defined by the tabs 52 and the arcuate side closure portions 50 interconnecting with inwardly directed ribs 72 which are molded into the side walls of the luminaire housing.

In mounting the fauna guard to the luminaire housing, the slots 54 are slipped over the molded projections 72 and the fauna guard rotated into place closing off the interior of the luminaire housing forward of the slip fitter. With the hinged door 22 in an open position, threaded bolt 70 is then placed through the aperture 66 and the tab 64 and threaded into the internally threaded boss 68.

As will be apparent from the foregoing, the small enlongated slots 58 and 56 which permit access wiring through the fauna guard are not large enough to permit access to the interior of the luminaire by small rodent type animals or birds and hence the fauna guard prevents this type of animal life from entering or nesting within the interior of the luminaire housing.

I claim:

1. In an outdoor lighting luminaire including an elongated housing having a slip fitter means at one therof for mounting said luminaire to a luminaire support and an optical cavity at the other end thereof for confining the reflector and light source, the improvement comprising closure means releasably secured within said elongated housing intermediate said slip fitter means and said optical cavity, said closure means substantially closing off said optical cavity portion of said luminaire from access thereto by small animals.

2. The luminaire according to claim 1 wherein said luminaire housing includes a central internally threaded boss and a pair of laterally disposed ribs on the interior surface thereof and said closure means is a generally planar plate member having an apertured tab extending normal thereto for interconnection to said threaded boss and a pair of lateral tab formed slots for receiving the laterally disposed ribs on said housing.

3. The luminaire according to claim 2 wherein said generally planar plate member includes a first wiring access slot adjacent the top edge thereof and a second wiring access slot adjacent the bottom edge thereof.

4. An outdoor lighting luminaire comprising:

an elongated open bottom housing having a slip fitter means at the rearward end thereof, an optical cavity at the forward end thereof and a ballast containing portion intermediate said slip fitter means and said optical cavity;

door means including an optical refractor carried thereby closing off the portion of said open bottom housing containing said optical cavity and said ballast containing portion; and an access limiting closure plate mounted within said housing intermediate said slip fitter means and said ballast containing portion, said access limiting closure plate preventing access to said optical cavity by small animals.

5. The luminaire according to claim 4 wherein said luminaire housing includes a central internally threaded boss and a pair of laterally disposed internally directed ribs on the interior surface thereof and said access limiting closure plate includes a generally planar plate member having an apertured tab extending normal thereto for interconnection to said threaded boss and a pair of lateral tab formed slots for receiving laterally disposed ribs on said housing.

6. The luminaire according to claim 5 wherein said generally planar plate member includes an upper wiring access slot adjacent the top edge thereof and a lower wiring access slot adjacent the bottom edge thereof.

7. The luminaire according to claim 6 wherein said first wiring access slot adjacent the top edge of said access limiting closure plate is constructed and arranged to permit wiring from a photo control socket to the interior of said luminaire housing and said lower wiring access slot is constructed and arranged to carry a power cable to the interior of the luminaire housing.

8. The luminaire according to claim 4 wherein said access limiting closure plate includes a central planar portion having perpendicular side walls and a perpendicular bottom wall, said perpendicular side walls terminating in laterally and perpendicularly extending arcuate closure portions having an outer edge contour substantially equivalent to the internal contour of said luminaire housing.

* * * * *